US007994997B2

(12) United States Patent
Livingston et al.

(10) Patent No.: US 7,994,997 B2
(45) Date of Patent: Aug. 9, 2011

(54) WIDE BAND LONG SLOT ARRAY ANTENNA USING SIMPLE BALUN-LESS FEED ELEMENTS

(75) Inventors: Stan W. Livingston, Fullerton, CA (US); Jar J. Lee, Irvine, CA (US); Dennis Nagata, Fullerton, CA (US)

(73) Assignee: Raytheon Company, Waltham, MA (US)

( * ) Notice: Subject to any disclaimer, the term of this patent is extended or adjusted under 35 U.S.C. 154(b) by 408 days.

(21) Appl. No.: 12/163,091

(22) Filed: Jun. 27, 2008

(65) Prior Publication Data

US 2009/0322637 A1 Dec. 31, 2009

(51) Int. Cl.
*H01Q 13/10* (2006.01)

(52) U.S. Cl. ..... 343/770; 343/853

(58) Field of Classification Search ..... 343/770, 343/771, 767, 853, 864
See application file for complete search history.

(56) References Cited

U.S. PATENT DOCUMENTS

| | | | | |
|---|---|---|---|---|
| 5,068,670 | A | 11/1991 | Maoz | |
| 5,428,364 | A | 6/1995 | Lee et al. | |
| 5,955,997 | A * | 9/1999 | Ho et al. | 343/767 |
| 5,966,101 | A * | 10/1999 | Haub et al. | 343/767 |
| 6,388,631 | B1 | 5/2002 | Livingston et al. | |
| 6,480,162 | B2 * | 11/2002 | Sabet et al. | 343/767 |
| 7,315,288 | B2 | 1/2008 | Livingston et al. | |
| 7,522,114 | B2 * | 4/2009 | Brown et al. | 343/767 |
| 2005/0156802 | A1 | 7/2005 | Livingston et al. | |

FOREIGN PATENT DOCUMENTS

| | | | |
|---|---|---|---|
| EP | 1798818 | A1 | 6/2007 |
| WO | 2004062035 | A1 | 7/2004 |

OTHER PUBLICATIONS

Neto, Andrea et al., "'Infinite Bandwidth' Long Slot Array Antenna," IEEE, Antennas and Wireless Propagation Letters, vol. 4, 2005, pp. 75-78.

Lee, J. J. et al.: "Long Slot arrays—Part 2: Ultra Wideband Test Results", Antennas and Propagation Society Symposium, IEEE, vol. 1A, Jul. 3, 2005, pp. 586-589.

International Search Report for International Application No. PCT/US2009/048815 dated Sep. 11, 2009.

* cited by examiner

*Primary Examiner* — HoangAnh T Le
(74) *Attorney, Agent, or Firm* — Pillsbury Winthrop Shaw Pittman LLP

(57) ABSTRACT

In one embodiment, a wide bandwidth, reduced depth transmit/receive antenna array includes unit cells having continuous slots, a transceiver, unbalanced feeds, impedance transformers, and exciters. The continuous slots are formed in a conductive antenna plane, and the transceiver generates and/or receives electrical signals. The unbalanced feeds may be electrically connected between the transceiver and impedance transformers which match the impedance between feed lines and the exciter. They may be located in a plane perpendicular to the direction of propagation of the radiation, and also may be arranged between the conductive antenna plane and a backplane. The exciter spans a continuous slot, and emits and/or receives radiation from the slot. The antenna array is capable of operating without a radome or balun.

19 Claims, 5 Drawing Sheets

WIDE BAND LONG SLOT ARRAY ANTENNA USING SIMPLE BALUN-LESS FEED ELEMENTS

BACKGROUND

This application is related to slot-array antennas, in particular, to wide-bandwidth long-slot antenna arrays. Slot-array antennas have apertures theoretically capable of maintaining a constant driving impedance of 377 ohms (Ω) over a wide-bandwidth, for example, over a bandwidth greater than $F_{max}-0.01*F_{max}$ (i.e., 100:1). However, conventional long-slot antenna arrays are limited by their backplanes and antenna feeds. Conventional antenna arrays are not suitable for many wide-bandwidth applications because they have narrow-bandwidth and/or are physically too thick. Patch antennas generally have a lower profile, but lack sufficient bandwidth necessary for many applications.

In contrast, tapered-slot antenna arrays, analogous to horn antennas, have wide-bandwidth but require considerable depth. In particular, tapered-slot antenna arrays have tapers which may extend behind the radiating elements over a distance of a wavelength or more. It is necessary to use long taper lengths to achieve wide-bandwidth because the taper provides a transition which matches the impedance of the antenna array's transceiver electronic modules and feed lines to the impedance of the environment. The longer the transition between the impedance of the transceiver and the environment, the greater the bandwidth the antenna array can achieve. Thus, conventional taper elements obtain wide-bandwidth at the expense of long taper lengths and increased antenna thickness and overall size.

High performance surveillance and other critical missions benefit from ultra wide-bandwidth (UWB) capabilities in the Ultra High Frequency (UHF) spectrum and below. Furthermore, they require high resolution, diversity, and/or multi-radio-frequency (RF) functionality on platforms where antenna volume and/or footprint is limited. However, since UHF radiation has wavelengths on the order of 1 meter, conventional wide-bandwidth tapered slot antennas are large, costly, and impractical.

Other conventional UWB long-slot antenna arrays provide impedance transformers in discrete circuits behind the backplane. Similarly, the thickness of these antenna arrays is increased and may be greater than desired. Furthermore, conventional apertures use radiating elements that required balanced feed lines, such as twin lead cable, which has two parallel conductors formed within an insulating material, similar to a ribbon-cable. When a balanced antenna, such as a dipole, is fed with an unbalanced feed line (e.g., coaxial cable) undesirable common mode currents may form between the inner and outer conductors. As a result, both the unbalanced line and the antenna may radiate, which may reduce efficiency, distort the radiation pattern of the antenna array, and/or induce interference in other electronic equipment.

In order to convert an unbalanced feed line to a balanced feed line, conventional antenna arrays have used a balun. Conventional baluns, however, are expensive, inefficient, and have limited bandwidth and power capability. Additionally, although some conventional UWB long-slot antenna arrays do not require a balun, it may be necessary to provide the antenna array with a thick and heavy dielectric radome for impedance matching.

Accordingly, conventional antenna arrays are insufficient and unsuitable for certain applications since they require balanced feed lines or radomes, do not have a low profile or wide-bandwidth, and/or are not capable of operating over low frequencies. Therefore, antenna arrays having greater performance and smaller profiles, particularly less thickness in the direction of propagation are desired.

SUMMARY

According to various embodiments and aspects of this disclosure, an UWB long-slot antenna array having low thickness, weight, and cost is provided. In one aspect, the antenna array has an approximately 10:1 or greater bandwidth and a thickness less than approximately 1/20th the wavelength of the lowest operating frequency. As a result, the antenna array has approximately 200 times the bandwidth of antenna arrays having similar thickness (e.g. a quarter-wave patch antenna). In addition, the antenna array is approximately 1/20th the size of antennas having similar bandwidth (e.g., quad-ridged horn exited by a flare). Furthermore, the complexity of the feed lines is reduced by driving the long-slots with single-sided unbalanced impedance matching feed probes located within a multi-layer monolithic tile structure.

These and other objects, features, and advantages of the inventive concept will be apparent from this disclosure. It is to be understood that the summary, detailed description, and drawings are not restrictive of the scope of the inventive concept described herein.

DETAILED DESCRIPTION

Figure 1A:
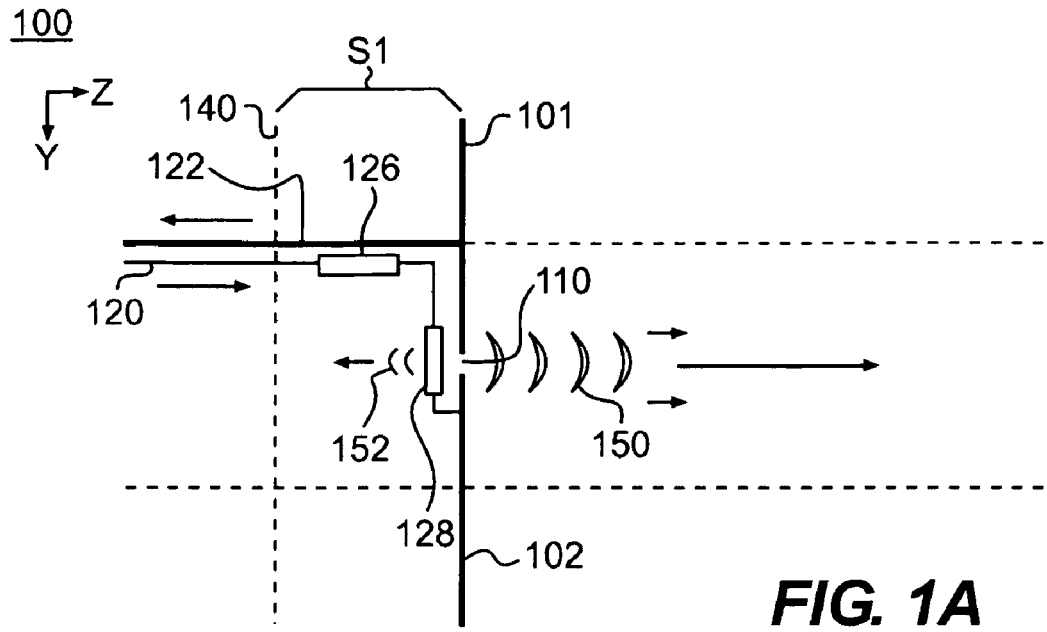
FIG. 1A shows a side view of a unit cell of a long-slot antenna array and the formation of a beam of radiation therefrom.

FIG. 1A shows, according to an embodiment, a unit cell radiation element 100 of a long-slot antenna array and the formation of a beam of radiation 150. In particular, conductors 101 and 102 are provided in an antenna plane. Conductors 101 and 102 can be, for example, conductive strips which are spaced apart from one another to form slot 110. In an embodiment, the conductive strips can be metal strips, such as copper. Feed line 120 carries electrical signals associated with radiation beam 150 (e.g., propagated in an active mode, and received in a passive mode) between a transceiver (not shown) and impedance transformer 126, respectively. Impedance transformer 126 matches the impedance between feed line 120 and the impedance of the environment in order to efficiently couple the electrical signal into radiation beam 150 (i.e., in the active mode) or from beam 150 (i.e., in the passive mode). Impedance transformer 126 is electrically connected to excitation probe 128, which spans slot 110 and is further electrically connected to conductor 102. Excitation probe 128 can be configured as a single-ended unbalanced excitation probe. For example, if feed line 120 is coaxial cable, the inner conductor can electrically connect the source to conductor 102. In addition, the outer conductor can electrically connect conductor 101 to ground 122. In an active mode, applying the electrical signal across slot 110 with the excitation probe results in a current that causes slot 110 to emit radiation beam 150 and a backward propagating radiation beam 152. With a suitable backplane arrangement, backward propagating radiation beam 152 can be reflected by backplane 140 in such a manner as to combine with radiation beam 150 to maximize gain in the forward direction.

Figure 1B:
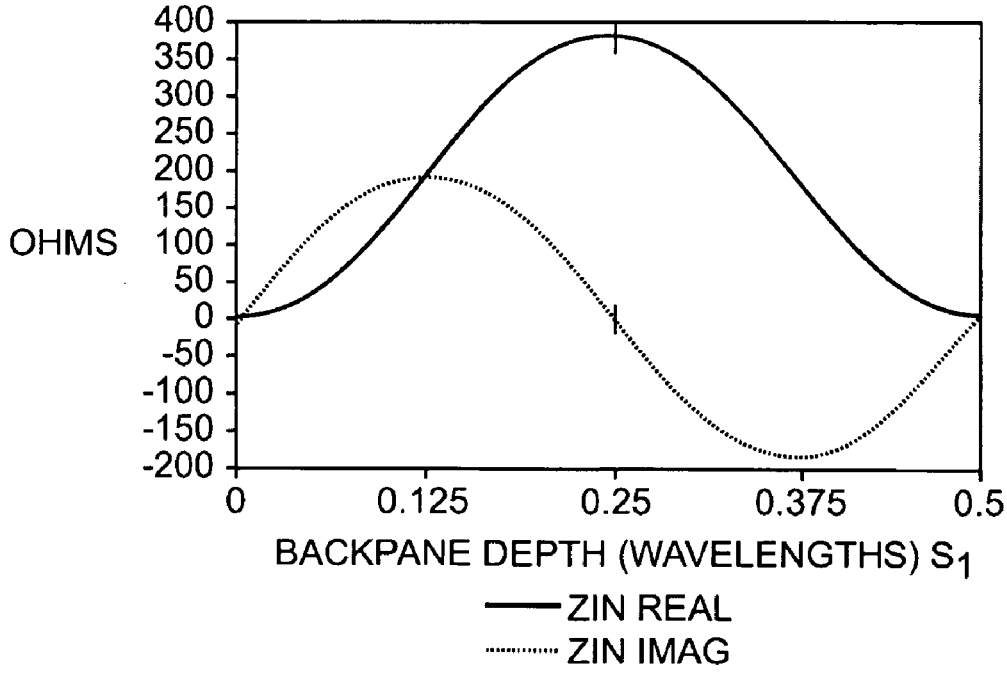
FIG. 1B shows the real and imaginary components of impedance as a function of the position of a backplane.

FIG. 1B shows the impedance of backplane 140 as a function of the depth of backplane 140 behind conductors 101 and 102 (i.e., the antenna plane). In particular, the imaginary component of impedance indicates the portion of power flow that is due to stored energy and which does not result in net transfer of power. The imaginary component of impedance is 0Ω at a distance of 0, 0.25, and 0.5 wavelengths (λ) behind the antenna plane. In contrast, the real component of impedance indicates the portion of power flow which results in net transfer of power. The real component of impedance is maximized at a distance of 0.25λ behind the antenna plane. Since the imaginary component of impedance is at a minimum at 0.25λ, and the real component is at a maximum, gain in the forward propagating direction can be maximized by providing backplane 140 at a distance of 0.25λ behind the antenna plane.

In an implementation illustrated in FIGS. 1A and 1B, backplane 140 can be configured as a grounded conducting metal backplane. Further, metal backplane 140 can be configured as a quarter-wave short by locating it at a distance S1, approximately 0.25λ of the mid-band frequencies, behind conductors 101 and 102. According to this implementation, a 4:1 bandwidth can be achieved with small reflection losses when using a TEM transmission line feed. Additionally, a bandwidth of at least 10:1, with a loss of 2-3 dB, can be achieved by configuring backplane 140 as an absorber, such as a ferrite.

Figure 2:
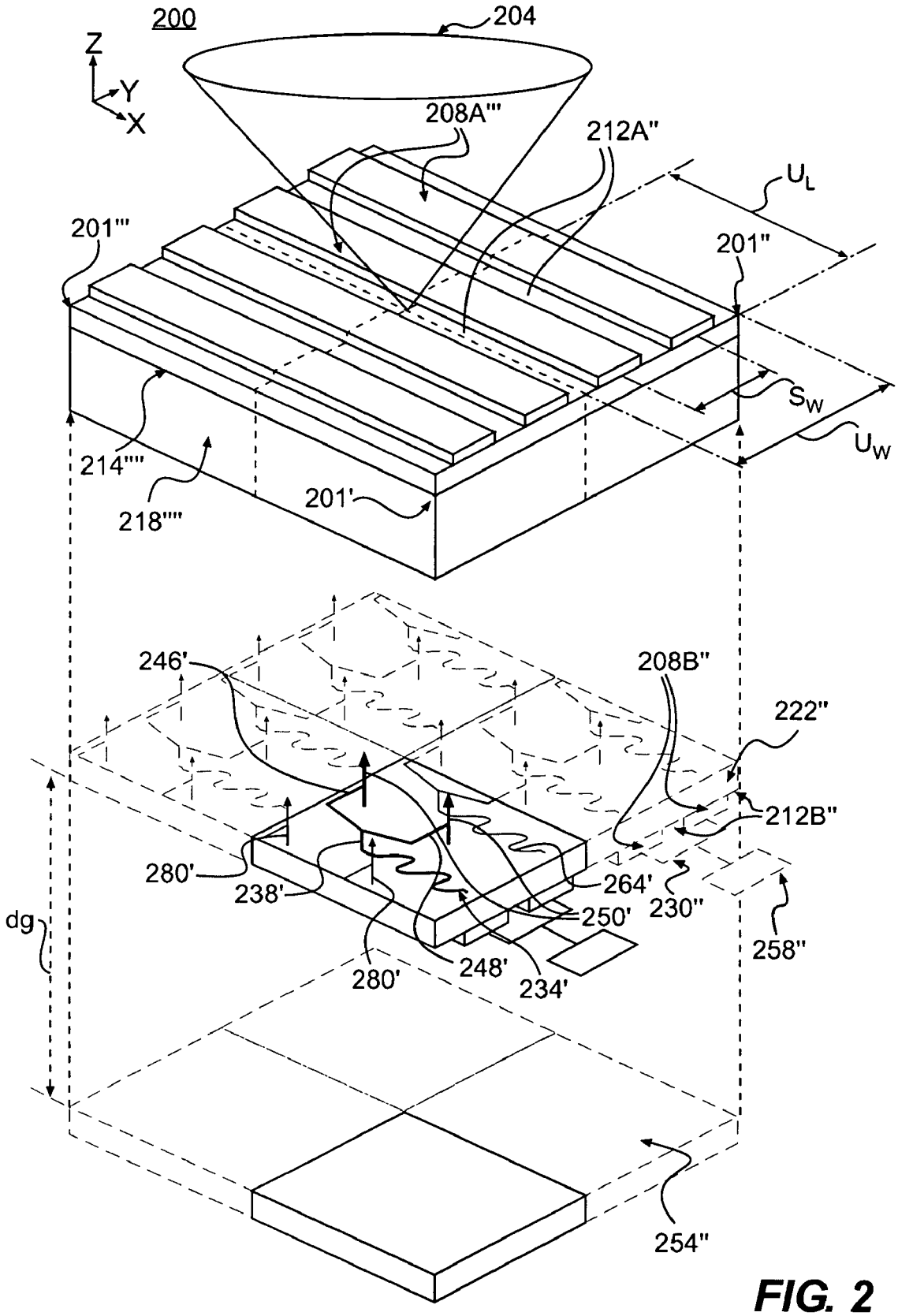
FIG. 2 shows an exploded view of four unit cells of an array of elements for transmitting and/or receiving radiation.

FIG. 2 shows an antenna array 200 for transmitting and/or receiving radiation beam 204. The orientation of radiation beam 204 can be controlled, for example, by adjusting the relative phase between adjacent antenna feeds. In addition, the precision of the radiation pattern can be increased, and its vulnerability to noise decreased, by minimizing the formation of grating lobes in the portions of the far-field radiation pattern that are not part of the main beam. Furthermore, the direction of the beam or pattern 204 can changed, thus allowing radiation beam 204 to be steered and/or electronically scanned. For example, radiation beam 204 can be configured to be steered or scanned over an angle of substantially ±60 degrees to the XY plane (i.e., a 120 degree cone of radiation).

Antenna array 200 includes a plurality of unit cell radiation elements 201 (e.g., 201', 201", 201''', and 201''''). Each unit cell 201 is a portion of antenna array 200 and includes a group of elements which are representative of both the arrangement and composition of the entire antenna array 200. Unit cells 201 are the fundamental units of the repeating pattern of elements in antenna array 200. Since each unit cell 201 has similar functionality, the structure and operation of the entire antenna array 200 can be described with respect to a single unit cell 201. Accordingly, prime notation (i.e., ', ", ''', and '''', respectively) is used to denote a particular element of a group of equivalent elements. In addition, an element number without one or more primes is intended to represent all elements of a group of equivalent elements. For example, 201', 201", 201''', and 201'''' refer to four different unit cells individually, whereas 201 refers to all unit cells collectively.

Each unit cell 201 has a characteristic impedance. In order to minimize reflections of the electrical signal caused by a mismatch in impedance and to maximize the power coupled into radiation beam 204, the characteristic impedance of each unit cell 201 must be matched to the impedance of the environment, i.e., 377Ω for free space. The impedance (Z) of the environment is a function of the length $U_L$ and width $U_W$ of the unit cell (i.e., $Z=377*U_W/U_L$). In an embodiment where unit cell 201 is square (as show in FIG. 2), the impedance of the environment with respect to unit cell 201 is 377Ω.

Furthermore, each unit cell 201 includes a plurality of layers. An antenna plane is formed by conductors 208A. Conductors 208A are continuous across unit cells 201 (e.g., across 201' and 201''''). In an embodiment, for example, conductors 208A can be conductive metal strips.

Conductors 208A can be provided on dielectric layer 214, such as a dielectric film. In various embodiments, conductors can formed by depositing a conductive material directly onto dielectric layer 214, or by etching away portions of a conductive surface, such as copper-clad foam, for example. Similarly, conductors 208B can be provided in alignment with, and spaced apart from, conductors 208A. Conductors 208A and 208B can be electrically connected to one another, as described below.

Slots 212A are formed between conductors 208A and are continuous across unit cells 201 (e.g., across 201' and 201'''', as shown in FIG. 2). Slots 212A are the apertures of unit cells 201 through which radiation is transmitted to and/or received from the environment. Slots 212A can be configured to have a width $S_W$ less than approximately the shortest operating wavelength. In addition, slots 212A can be configured such that the length of a continuous slot formed by adjacent slots (e.g., 201' and 20'''', as shown in FIG. 2) has a total continuous length which is greater than approximately λ/2 of the longest operating wavelength.

Backplane 254 may be provided behind slots 212A and conductors 208A. Backplane 254 can be located at a distance ($d_g$) behind dielectric 222. The particular location of backplane 254 may be selected to maximize power transfer into and out of radiation beam 204. In an embodiment, backplane 254 is located approximately 0.25λ behind dielectric 222. Backplane 254 may also serve to shield the electronics in antenna array 200 from external electrical signals and electromagnetic radiation. In addition, backplane 254 can minimize the back lobe and maximize the main lobe of radiation beam 204, thus improving the forward gain of antenna array 200. Backplane 254 can have a variety of configurations and comprise various materials. For example, backplane 254 can be configured as a metallic conductor, an absorber, a ferrite-loaded reflector, or a meta-material (i.e., a material having beneficial properties due to both its structure and composition).

Although antenna array 200 can be configured to emit and receive radiation, the following description is primarily given from the perspective of antenna array 200 during transmission of radiation beam 204. Since the process of receiving radiation beam 204 is substantially the reverse of transmitting radiation beam 204, it is understood that antenna array 200 will substantially operate in a reciprocal manner when receiving radiation beam 204 than when transmitting radiation beam 204.

In an embodiment of FIG. 2, antenna array 200 includes transceiver electronic module 258 to transmit and/or receive an electronic signal associated with radiation beam 204. Transceiver electronic module 258 may contain, for example, one or more power supplies, oscillators, modulators, amplifiers, transmit-receive switches, circulators, and phase shifters. Transceiver 258 can therefore generate the electrical signal necessary to form a desired radiation beam 204 and/or radiation beam pattern. In addition, when antenna array 200 is receiving, transceiver 258 can receive the electronic signal associated with radiation beam 204 for subsequent processing.

In an embodiment, transceiver 258 is electrically connected to impedance transformers 234 and 264. The number of transceivers 258 can be reduced, without losing spatial resolution or generating grating lobes in radiation beam 204, by driving impedance transformers 234 and 264 in common (e.g., in phase). In various embodiments, the ratio of transceivers 258 to impedance transformers 234 and 264 can be different than 1:2.

Transceiver 258 can contain a phase-shifter to adjust the phase of the electronic signal. By changing the phase of unit cells 201 relative to one another, the pattern of constructive and destructive interference between unit cells 201 can be modified. As a result, radiation beam 204 can be steered in a desired direction or scanned by continuously adjusting the relative differences in phase. In an embodiment, for example, radiation beam 204 can be directed within a cone of approximately 120 degrees.

Feed line 230 electrically connects transceiver 258 with impedance transformers 234 and 264. In an embodiment, for example, feed line 230 can be insulated from conductors 208B, and also connect vertically through conductors 208B to impedance transformers 234 and 264 (e.g., using a GPO coaxial connector). In order to maximize power transfer and minimize losses due to reflection, the impedance of feed line 230 must be matched with the impedance of transceiver 258 and with the impedance of impedance transformers 234 and 264.

In an embodiment, feed line 230 can be coaxial cable having an impedance of 50Ω. Coaxial cable may be selected for feed line 230 because coax is relatively immune to interference since its inner conductor is substantially shielded by its outer conductor. Furthermore, it is available in a variety of configurations and is relatively easy to use.

Coaxial cable, however, is an unbalanced feed line. In particular, its conductors are not symmetrical because the outer conductor (i.e. the shield) is grounded, whereas the inner conductor is not grounded. Additionally, the inner and outer conductors have different current densities. Conventional antenna arrays, as a result, have suffered from limited bandwidth when using unbalanced feed lines. In contrast, the performance of antenna array 200 is not compromised by use of an unbalanced feed line, such as coaxial cable, due to the impedance matching characteristics.

Impedance transformers 234 and 264 are electrically connected to transceiver 258 by feed line 230. The operation of antenna array 200 is described primarily with respect to the circuit branch comprising impedance transformer 234, which is the portion of unit cell 201' illustrated by the darker lines in FIG. 2. The operation of the circuit branch comprising impedance transformer 264 is not described in the degree of detail accorded to the circuit branch comprising impedance transformer 234 since they both function in an analogous manner.

Impedance transformer 234 provides a transition between, and matches the impedance of, transceiver 258, exciter probes 246 and 248, and the environment. In an embodiment, the arrangement of unit cells 201 can reduce the magnitude of the change in impedance required to be provided by impedance transformer 234. For instance, the impedance (Z) of a square unit cell 201 is 377Ω (Z=377*UW/UL). However, in an embodiment, the impedance of unit cell 201 is effectively reduced to 188Ω from the perspective of impedance transformers 234 and 264. This can be accomplished by doubling the number of slots 212A and 212B per unit cell 201 (i.e., reducing the element spacing in the E-plane to half). For example, two sets of circuits can be provided for emitting and receiving radiation (i.e., the circuit branches comprising impedance transformers 234 and 264, respectively) in the Y-direction per unit cell. As a result, the width of unit cell 201 $U_W$ is effectively $U_W/2$ for the purpose of determining the change in impedance necessary to be provided by impedance transformers 234 and 264.

In an embodiment, transceiver 258 and feed line 230 each have an impedance of 50Ω, and the total impedance of exciter probes 246 and 248 together, and the impedance of the environment are 188Ω. Accordingly, a 4:1 impedance transformer is required to increase the impedance from 50Ω to 188Ω. In contrast, if it were necessary for impedance transformers 234 and 264 to match an impedance of 377Ω, it would be necessary to provide 8:1 impedance transformers. Therefore, impedance transformers 234 and 264 can be made smaller due to the change in impedance provided by impedance transformers 234 and 264.

The impedance of transformers 234 and 264 can be varied in order to provide the required change in impedance. For example, the impedance can be varied by changing the length of the impedance transformer, the width and/or tapered width of its conductor (or conductors), its overall geometry, and/or the dielectric constant of dielectric 222 on which it rests. In various embodiments, impedance transformer 234 can be configured, for example, as lumped elements, a stripline, a shielded microstrip, or a Klopfenstein tapered transformer. For example, in an embodiment, the width of a conductor in a Klopfenstein tapered transformer can be configured to narrow from approximately 0.050 in. to approximately 0.004 in. In an embodiment, impedance transformer 234 can provide a relatively large change in impedance on a low dielectric substrate at a low manufacturing cost. Other configurations of impedance transformers 234 and 264 are possible, as would be appreciated by one of ordinary skill in the art in light of this disclosure.

Additionally, the arrangement of impedance transformer 234 can minimize the thickness of antenna array 200. In an embodiment, impedance transformer 234 is located in a plane that is substantially parallel to conductors 208A (i.e., the X-Y plane). In contrast, conventional antenna arrays provide impedance matching in a direction perpendicular to the antenna plane (i.e., in the Z direction). Accordingly, these conventional antenna arrays are required to be thicker in the Z direction than in embodiments of this disclosure.

Impedance transformer 234 can be arranged in a plane behind conductors 208B, for example. Additionally, impedance transformer 234 can be arranged in a plane between conductors 208A and 208B, as shown in FIG. 2. Enclosing impedance transformer 234 between conductors 208A and 208B enables the space to be more effectively utilized and also shields impedance transformer 234 from external electrical signals and electromagnetic interference.

Impedance transformer 234 is electrically connected to the bottom of vertical riser 238. Vertical riser 238 is a conductor and extends upwards through dielectric 218. In an embodiment, as shown in FIG. 2, vertical riser 238 extends approximately midway through dielectric 218. The top of vertical riser 238 is electrically connected to exciter probes 246 and 248. Vertical riser 238 provides a point from which exciter probes 246 and 248 can split into separate branches. Furthermore, vertical riser 238 allows exciter probes 246 and 248 to be located on a different level than impedance transformer 234. Thus, exciter probes 246 and 248, and impedance transformer 234 are less likely to interfere with one another, either physically or electrically. In an embodiment, impedance transformer 234 may be provided at the same level as exciter probes 246 and 248, and impedance transformer 234 can be connected directly to exciter probes 246 and 248 without vertical riser 238. Accordingly, the complexity of antenna array 200 can be reduced, for example, when impedance transformer 234 and exciter probes 246 and 248 would not otherwise interfere with one another.

Excitation probes 246 and 248 can be configured to be single-sided, unbalanced, and impedance matched, in contrast to conventional approaches that are double-sided and balanced. They span slot 212A and can be periodically positioned along conductors 208A and 208B. When an electrical signal is applied to excitation probes 246 and 248, they cause currents which excite slot 212A to emit radiation. Furthermore, excitation probes 246 and 248 are arranged such that the impedance of unit cell 201 is effectively reduced, and are impedance matched with impedance transformer 234 and the environment.

In an embodiment, the impedance of exciter probes 246 and 248 is configured to match the impedance of transformer 234 and an environment impedance of 188Ω. For example, the impedance of each exciter probe 246 and 248 can be configured to be 377Ω. When exciter probes 246 and 248 are configured to be electrically parallel, as shown in FIG. 2, the total impedance of both exciter probes 246 and 248 is reduced to 188Ω by the parallel combination. In various embodiments, different numbers of exciter probes can be arranged in an electrically parallel manner in order to provide the total impedance desired for the group of electrically parallel exciter probes.

Exciter probes 246 and 248 are electrically connected to direct contacts 250, for example, near a mid-point of direct contacts 250. Direct contacts are conductors which are also electrically connected between conductors 208A and 208B. Direct contacts 250 provide a point to which the ends of exciter probes 246 and 248 can be attached. In addition, they enable exciter probes 246 and 248 to be electrically connected to ground potential via conductors 208A and 208B.

As a result, it is possible for antenna array 200 to realize wide-bandwidth with fewer components. For example, antenna array 200 is "balun-less," i.e., it does not require a balun to match impedance and to convert from an unbalanced feed line to a balanced feed line. Antenna array 200 can incorporate impedance transformers 234 and 264 in a plane parallel to conductors 208A, thus minimizing the depth of antenna array 200. Furthermore, antenna array 200 does not require a radome. Accordingly, antenna array 200 is less costly and complex to implement than various conventional alternatives.

The size of antenna array 200 and the number of unit cells 201 is determined by the range of operating frequencies of antenna array 200. In particular, when the bandwidth of antenna array 200 is extended to progressively longer operating wavelengths, the size of antenna array 200 can be increased. In an embodiment, the width and/or length of antenna array 200 is substantially at least one-half the wavelength of the longest operating wavelength. Furthermore, as the bandwidth of antenna array 200 is extended to progressively shorter wavelengths, the number of unit cells 201 can be increased, and thus the spacing of exciter probes 246 and 248 can be decreased.

The number of required unit cells 201 can be determined based on the necessary spatial interval of unit cells 201. In particular, an analogy can be drawn to the Nyquist theorem wherein sampling at least every half wavelength spatially preserves the bandwidth spectrum of the frequencies being transmitted or received. If the sampling condition is not satisfied, the same set of sample values may correspond to multiple different frequencies and the signal cannot be resolved unambiguously. Additionally, if the sampling condition is not satisfied, antenna array 200 may not be able to form radiation beam 204 without also creating undesirable grating lobes or side lobes.

In an embodiment, the length $U_L$ and width $U_W$, of a unit cell 201 is substantially one-half the Nyquist spatial interval in order to satisfy the spatial sampling condition. Furthermore, the distance between exciter probes 246 and 248 (i.e., in the X-direction) is substantially one-half the Nyquist spatial interval (i.e., one-fourth the wavelength of the highest operating frequency). Additionally, the distance between respective portions of adjacent exciter probes (i.e., in the Y-direction) is also substantially one-half the Nyquist spatial interval. For example, the distance between the ends of adjacent exciter probes (i.e., between 250 and 280 in the Y-direction) is substantially one-fourth the wavelength of the highest operating frequency. Thus, each exciter probe 246 and 248 is spaced within, and between, unit cells 201 at a distance of substantially one-fourth the wavelength of the highest operating frequency in both the X and Y directions. For example, as shown in FIG. 2, probe 246' is located at a distance of one-quarter wavelength from 248"".

Figure 3:
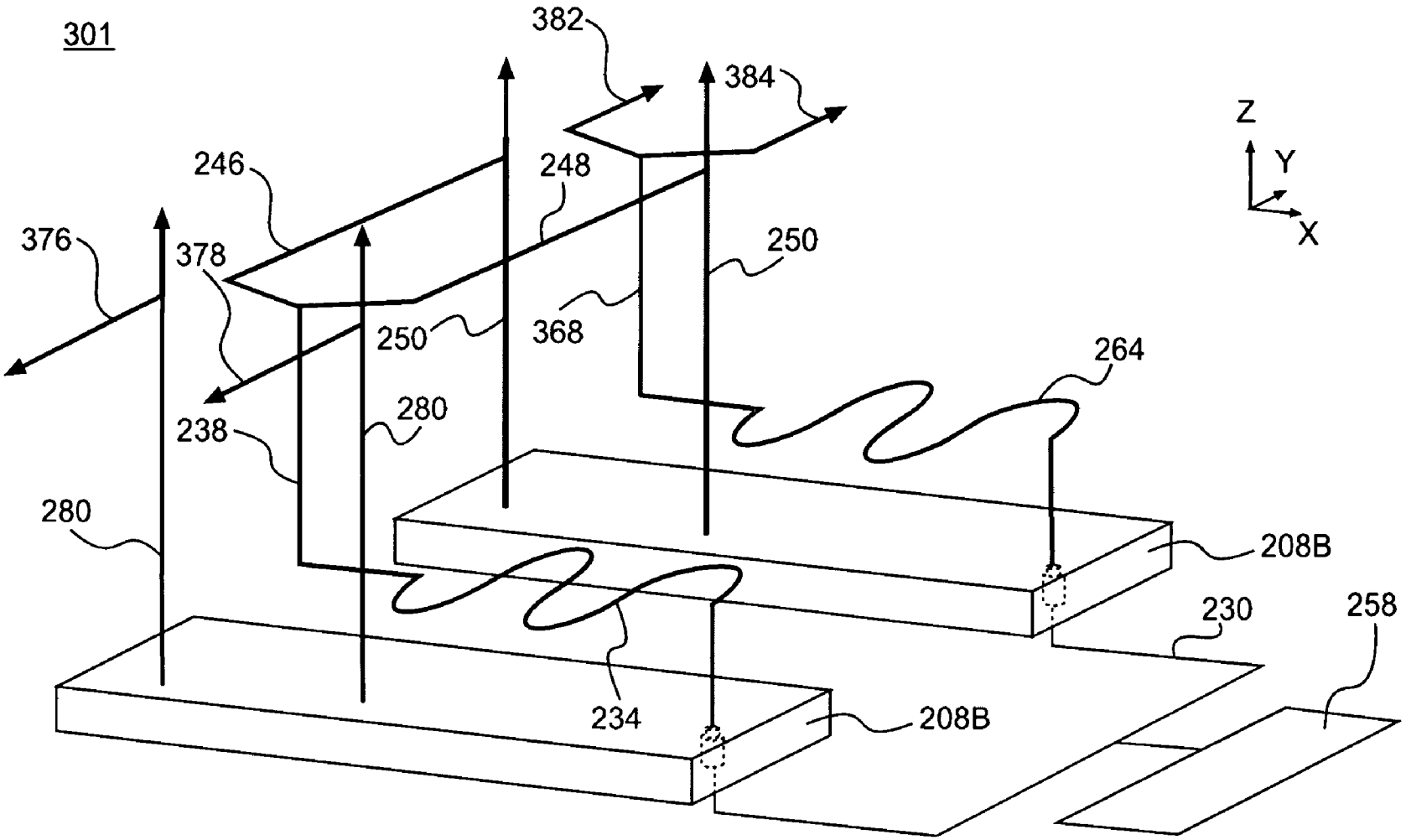
FIG. 3 shows a unit cell comprising impedance matching circuits of an embodiment.

FIG. 3 shows a skeleton view of unit cell 301. In particular, conductors 208A and 208B, and dielectric layers 214, 218, and 222 (relative to FIG. 2) have been removed in order to more clearly illustrate the interconnection of various electrical components within antenna array 200.

Antenna array 200 can be produced by repeating unit cell 301. It is recognized, however, that it may be necessary to modify unit cell 301 to eliminate or terminate incomplete impedance matching circuits for unit cells on the outer perimeter of antenna array 200 caused by lack of continuity of the pattern at the boundary. Unit cell 301 comprises portions of three different impedance matching circuits. The portions of the three different matching circuits yield two complete impedance matching circuits per unit cell 301. In particular, unit cell 301 wholly contains a primary impedance matching circuit comprising impedance transformer 234, exciter probes 246 and 248, and direct contacts 250 (corresponding to the darker illustrated portion in FIG. 2). In addition, unit cell 301 comprises a secondary impedance matching circuit having exciter probes 376 and 378, and direct contacts 380 (corresponding to a second portion of an impedance matching circuit). Furthermore, unit cell 301 comprises a tertiary impedance matching circuit comprising impedance transformer 264, vertical riser 368, and exciter probes 382 and 384 (corresponding to a first portion of an impedance matching circuit).

Transceiver 258 transmits and/or receives an electronic signal associated with radiation beam 204. Transceiver 258 is electrically connected to feed line 230. In addition, conductors 208B can be arranged in alignment with, and electrically connected to conductors 208A (not show in FIG. 3). Feed line 230 can be insulated from conductors 208B, and also configured to connect vertically through conductors 208B to impedance transformer 234. Impedance transformer 234 provides a transition between, and matches the impedance of, transceiver 258, exciter probes 246 and 248, and the environment. Impedance transformer 234 is electrically connected to the bottom of vertical riser 238. Vertical riser 238 provides a point from which exciter probes 246 and 248 can split into separate branches. In addition, vertical riser 238 allows exciter probes 246 and 248 to be located on a different level than impedance transformer 234. In an embodiment, impedance transformer 234 may be provided at the same level as exciter probes 246 and 248, and impedance transformer 234 can be electrically connected directly to exciter probes 246 and 248 without vertical riser 238.

Excitation probes 246 and 248 span slot 212A (not shown in FIG. 3) and excite slot 212A to emit radiation. Excitation probes 246 and 248 are arranged such that the impedance of unit cell 301 is effectively reduced, and impedance matched with impedance transformer 234 and the environment. In particular, according to an embodiment, by providing two complete impedance matching circuits per unit cell 301, the effective impedance of the environment as seen by the impedance transformer can be reduced by one-half Furthermore, in an embodiment, two excitation probes 246 and 248 are provided in parallel such that the total impedance of both exciter probes 246 and 248 is reduced. Exciter probes 246 and 248 are electrically connected to direct contacts 250. As a result, exciter probes 246 and 248 are electrically connected with conductors 208A and 208B.

Figure 4A:
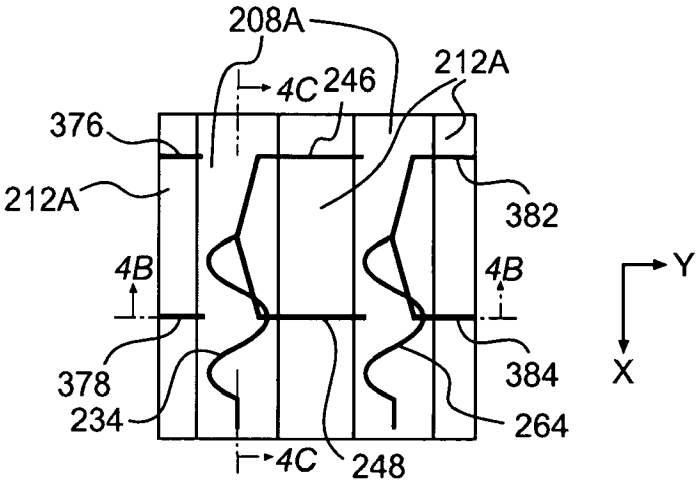
FIG. 4A shows a top view of a unit cell and provides a key depicting the locations of the cross-sections illustrated in FIGS. 4B and 4C.

FIG. 4A shows a top view of unit cell 201. Unit cell 201 comprises portions of three different matching circuits. In particular, a primary impedance matching circuit comprising impedance transformer 234 and exciter probes 246 and 248. In addition, unit cell 201 comprises a secondary impedance matching circuit comprising exciter probes 376 and 378. Furthermore, unit cell 201 comprises a tertiary impedance matching circuit comprising impedance transformer 264 and exciter probes 382 and 384.

Conductors 208A are located above impedance transformers 234 and 264 and can be connected so as to form an antenna plane. Impedance transformers 234 provide a transition to match the impedance of transceiver 258 and exciter probes 246 and 248.

Figure 4B:
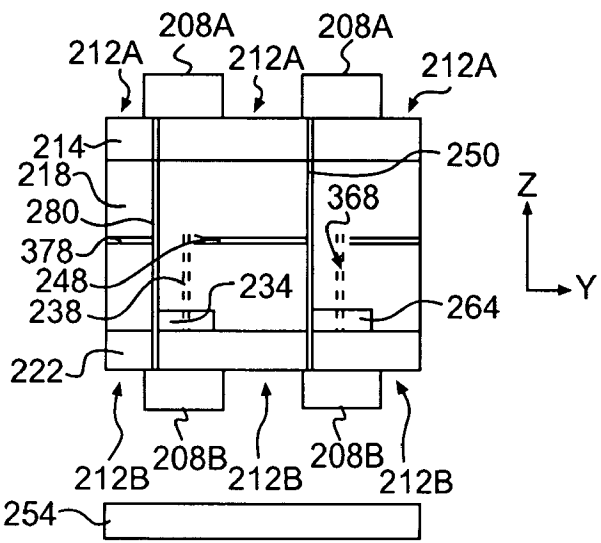
FIG. 4B shows a cross-section through a direct contact of an impedance matching circuit.

FIG. 4B shows a front view of unit cell 201. Conductors 208A are provided on the top surface of dielectric 214. Similarly, conductors 208B are provided on the bottom surface of dielectric 222. In an embodiment, dielectric 214 may be, for example, a polyimide film (e.g., a Kapton® film) which assists in the process of manufacturing antenna array 200 and/or conductors 208A. In an embodiment, for example, dielectric 222 may be a printed circuit board. Disposed between layers of dielectric 214 and 222 is dielectric 218. In an embodiment, dielectric 218 comprises a layer of dielectric foam or air. As shown in FIG. 4B, dielectric 214 may be provided on dielectric 218. In an embodiment, dielectric 214 may be eliminated so that conductors 208A are provided directly on top of dielectric 218. In an embodiment, dielectrics 214, 218, and 222 provide support the electronic components located within unit cell 201.

Impedance transformers 234 and 264 are provided on dielectric 214. Other configurations and arrangements of impedance transformers 234 and 264 within, or below, dielectrics 214, 218, and 222 are possible. Furthermore, the dielectric constant of the material surrounding impedance transformers 234 and 264 can be selected to provide the necessary change in impedance.

Vertical risers 238 and 368 electrically connect impedance transformers 234 and 264 to exciter probes 248 and 384, respectively. Vertical risers 238 and 368 allows exciter probes 248 and 384 to be located on a different level than impedance transformers 234 and 264. Thus, exciter probes 248 and 384, and impedance transformers 234 and 264, respectively, are less likely to interfere with one another, either physically or electrically. In an embodiment, for example, impedance transformer 234 may be provided at the same level as exciter probes 246 and 248, and impedance transformer 234 can be electrically connected directly to exciter probes 246 and 248 without vertical riser 238.

Excitation probes 246 and 248 span slot 212A and excite slot 212A to emit radiation. Furthermore, excitation probes 246 and 248 are electrically connected to conductors 208A and 208B via direct contacts 250. In an embodiment, exciter probes 246 and 248 are electrically connected to ground potential via conductors 208A and 208B. Backplane 254 is provided below conductors 254.

Figure 4C:
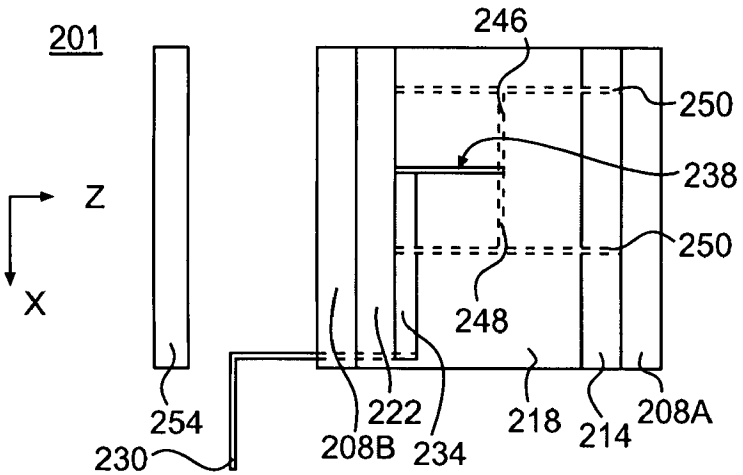
FIG. 4C shows a cross-section through a vertical riser of an impedance matching circuit.

FIG. 4C shows a side view of unit cell 201. Conductors 208A are provided on the top surface of dielectric 214. Similarly, conductors 208B are provided on the bottom surface of dielectric 222. Disposed between layers of dielectric 214 and 222 is dielectric 218. Feed line 230 can be configured to connect to impedance transformer 234 vertically through conductor 208B. In an embodiment, impedance transformer 234 is provided on dielectric 222. Impedance transformer 234 is electrically connected to vertical riser 238. Vertical riser 238 is also electrically connected to exciter probes 246 and 248 and provides a point from which exciter probes 246 and 248 branch. Vertical riser 238 enables impedance transformer 234 and exciter probes 246 and 248 to be located on a different levels, for example, between conductors 208A and 208B. Exciter probes 246 and 248 are electrically connected to direct contacts 250. Direct contacts 250 are electrically connected to conductors 208A and 208B.

An 11×11 array of unit cells 201 within a 3"×3" unit cell size was constructed in order to demonstrate the performance of antenna array 200. The antenna array was tested over 200-2000 MHz (i.e., 10:1 bandwidth) with both a detached metal backplane and a ferrite-loaded backplane. Additionally, the antenna array was determined to have±60 degrees of scan in both the E- and H-planes at the highest operating frequency without grating lobes.

Figure 5A:
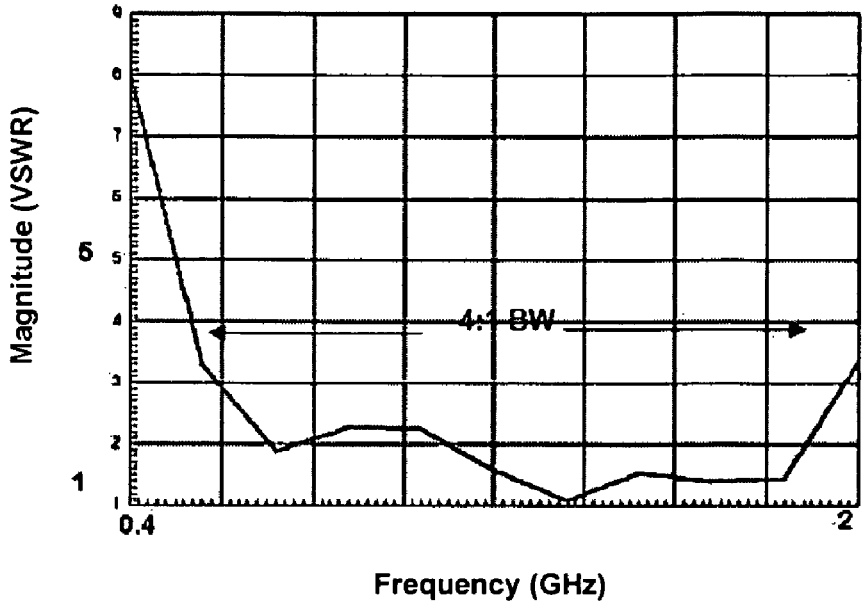
FIG. 5A shows the input reflection for a metal backplane.
Figure 5B:
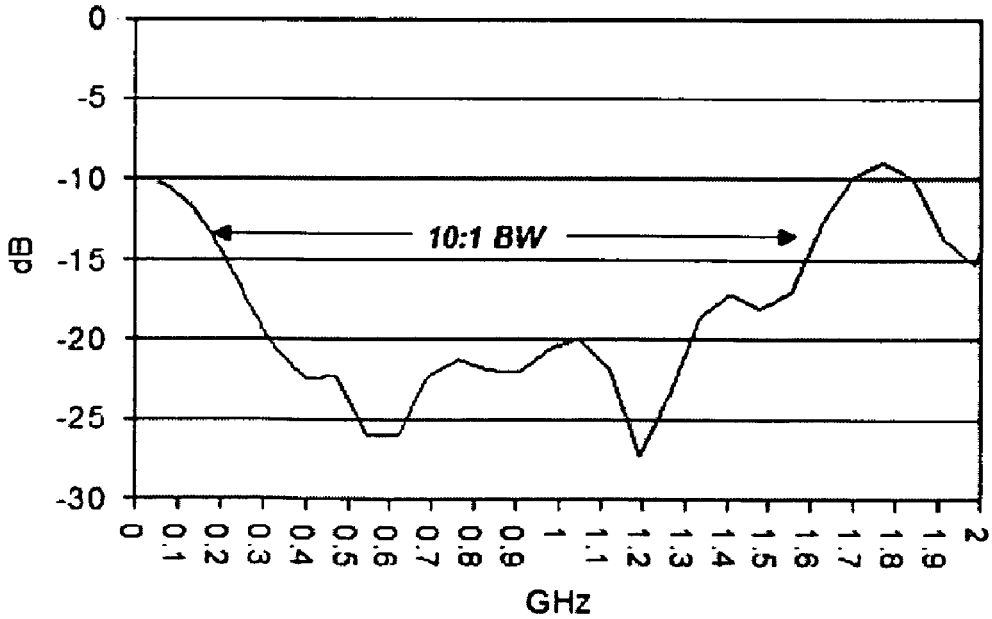
FIG. 5B shows the input reflection for a ferrite backplane.

FIG. 5A shows the input reflection over 0.4-2.0 GHz with a metal backplane depth of 1.875". FIG. 5B shows the loss when using a ferrite backplane over 0-2.0 GHz.

While particular embodiments of this disclosure have been described, it is understood that modifications will be apparent to those skilled in the art without departing from the spirit of the inventive concept such that the scope of the inventive concept is not limited to the specific embodiments described herein. Other embodiments, uses, and advantages will be apparent to those skilled in art from the specification and the practice of the claimed invention.

What we claim is:

1. An antenna element configured to transmit and/or receive a beam of radiation, comprising:

a first patterned conductive layer having one or more conductors and one or more slots formed therein;

an unbalanced feed line configured to transmit electrical signals associated with a beam of radiation without the use of a balun;

an impedance transformer electrically connected to the feed line;

one or more single unbalanced excitation probes spanning at feast one of the one or more slots, and electrically connected to the impedance transformer and the first patterned conductor layer, the one or more excitation probes configured to excite, or to be excited by, radiation from the one or more slots;

wherein the impedance transformer is configured to reduce the difference in impedance between the feed line and the one or more excitation probes such that the impedance of the feed line is matched to the impedance of the one or more excitation probes.

2. The antenna element of claim 1, further comprising a second patterned conductive layer spaced apart from the first patterned conductive layer and having one or more conductors formed therein.

3. The antenna element of claim 2, wherein the impedance transformer is located between the first patterned conductive layer and a second patterned conductive layer.

4. The antenna element of claim 1, further comprising a conductive electrical contact configured to electrically connect the impedance transformer with the one or more excitation probes.

5. The antenna element of claim 1, further comprising one or more electrical exciter contacts configured to electrically connect the one or more excitation probes with a conductor in the first conductive layer and/or with a conductor in a second conductive layer.

6. The antenna element of claim 5, wherein the one or more electrical exciter contacts of the one or more excitation probes are spaced within the antenna element at a distance of approximately one quarter wavelength of a mid-band operating frequency.

7. The antenna element of claim 5, wherein the one or more electrical exciter contacts of one or more adjacent antenna elements excitation probes are spaced at a distance of less than one-half wavelength of a mid-band operating frequency.

8. The antenna element of claim 1, wherein the impedance transformer comprises a conductor and the impedance of the impedance transformer is determined by one or more of a length of the conductor, a width of the conductor, a geometry of the conductor, and a dielectric constant of a dielectric on which the impedance transformer is provided.

9. The antenna element of claim 8, wherein the impedance transformer is one of a shielded microstrip or a stripline Klopfenstein transformer.

10. The antenna element of claim 1, wherein the feed line has a conductor configured to connect perpendicularly through a second patterned conductor to the impedance transformer.

11. The antenna element of claim 10, wherein the feed line has a second conductor configured to electrically connect a conductor in the second patterned conductive layer to a ground.

12. The antenna element of claim 1, wherein one or more slots form a continuous slot having a length greater than one-half the longest operating wavelength and a width less than the shortest operating wavelength.

13. The antenna element of claim 1, wherein a bandwidth of the antenna element as a ratio of the highest operating frequency to the lowest operating frequency is at least about 10:1.

14. The antenna element of claim 1, wherein a bandwidth of the antenna element as a ratio of the highest operating frequency to the lowest operating frequency is at least about 100:1.

15. The antenna element of claim 1, wherein the thickness of the antenna element is less than 1/20th of a wavelength of a lowest operating frequency.

16. The antenna element of claim 1, further comprising a transceiver configured to change a relative phase of the electrical signals such that the beam of radiation can be steered and/or electronically scanned.

17. The antenna element of claim 1, wherein the antenna element comprises a unit cell of an antenna array.

18. The antenna element of claim 1, further comprising a backplane, wherein the backplane comprises an absorber, a reflector, a ferrite, or a meta-material.

19. A method of radiating and/or receiving a beam of radiation with an antenna array, comprising:

providing a first patterned conductive layer having a plurality of conductors and a plurality of slots formed therein;

providing a plurality of unbalanced feed lines configured to transmit electrical signals associated with the beam of radiation without the use of a balun;

providing a plurality of impedance transformers electrically connected to respective feed lines;

providing a plurality of single ended unbalanced excitation probes spanning at least one of the plurality of slots and electrically connected to respective impedance transformers and the first patterned conductor layer, the plurality of excitation probes configured to excite, or to be excited by, radiation from respective slots;

wherein the plurality of impedance transformers are configured to reduce a difference in impedance between the feed lines and respective excitation probes such that an impedance of the feed lines is matched to an impedance of the respective excitation probes.

* * * * *

UNITED STATES PATENT AND TRADEMARK OFFICE

CERTIFICATE OF CORRECTION

PATENT NO. : 7,994,997 B2
APPLICATION NO. : 12/163091
DATED : August 9, 2011
INVENTOR(S) : Livingston et al.

It is certified that error appears in the above-identified patent and that said Letters Patent is hereby corrected as shown below:

Please correct Claim 1 as indicated below.

In Col. 10, Line 59, should read as: "... one or more single ended unbalanced ...".

In Col. 10, Line 60, please correct "at feast" to -- at least --.

Signed and Sealed this
Twenty-ninth Day of November, 2011

David J. Kappos

David J. Kappos
*Director of the United States Patent and Trademark Office*